US009518349B2

(12) United States Patent
Merkle et al.

(10) Patent No.: US 9,518,349 B2
(45) Date of Patent: Dec. 13, 2016

(54) LAUNDRY TREATING APPLIANCE AND METHOD OF CONTROL

(75) Inventors: Scott A. Merkle, Saint Joseph, MI (US); Dale E. Mueller, Benton Harbor, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 1115 days.

(21) Appl. No.: 13/571,400

(22) Filed: Aug. 10, 2012

(65) Prior Publication Data

US 2014/0041129 A1 Feb. 13, 2014

(51) Int. Cl.
*D06F 33/02* (2006.01)
*D06F 35/00* (2006.01)

(52) U.S. Cl.
CPC ..... *D06F 33/02* (2013.01); *D06F 35/007* (2013.01); *D06F 2204/065* (2013.01); *D06F 2204/08* (2013.01); *D06F 2204/084* (2013.01)

(58) Field of Classification Search
CPC .. D06F 33/02; D06F 35/007; D06F 2204/065; D06F 2204/08; D06F 2204/084
USPC ..... 8/158–159; 68/12.02, 12.14, 147, 200
See application file for complete search history.

(56) References Cited

U.S. PATENT DOCUMENTS

| | | | | |
|---|---|---|---|---|
| 5,590,552 | A | 1/1997 | Kim | |
| 5,596,889 | A | 1/1997 | Guerra et al. | |
| 5,687,440 | A | 11/1997 | Min et al. | |
| 2009/0183319 | A1* | 7/2009 | Chai et al. | 8/159 |
| 2011/0067186 | A1* | 3/2011 | Johansson | D06F 37/203 8/137 |
| 2011/0099724 | A1 | 5/2011 | Plata Amarillas et al. | |

FOREIGN PATENT DOCUMENTS

KR 100339003 B1 5/2002

* cited by examiner

*Primary Examiner* — Michael Barr
*Assistant Examiner* — Levon J Shahinian

(57) ABSTRACT

A method and apparatus for operating a laundry treating appliance having a tub and a rotatably wash basket, the method comprising draining at least a portion of a wash liquid, accelerating the wash basket, enabling the wash basket to decelerate and supplying a rinse liquid during at least a portion of the deceleration of the wash basket.

13 Claims, 4 Drawing Sheets

LAUNDRY TREATING APPLIANCE AND METHOD OF CONTROL

BACKGROUND OF THE INVENTION

Laundry treating appliances, such as clothes washers, typically include a tub in which is mounted a rotatable wash basket which receives laundry for treatment according to a cycle of operation. In a typical wash cycle, the laundry is often treated with a laundry detergent or other wash aid that includes surfactants. These surfactants may mix with liquid on the laundry and in the tub to generate suds. In some cases, the generation of suds may generate a suds lock condition and interfere with the rotation of the wash basket, thereby limiting the speed at which the wash basket may be rotated.

BRIEF DESCRIPTION

A method and apparatus for operating a laundry treating appliance having a tub and a rotatably wash basket, the method comprising draining at least a portion of a wash liquid, accelerating the wash basket, enabling the wash basket to decelerate and supplying a rinse liquid during at least a portion of the deceleration of the wash basket.

DESCRIPTION

Figure 1:
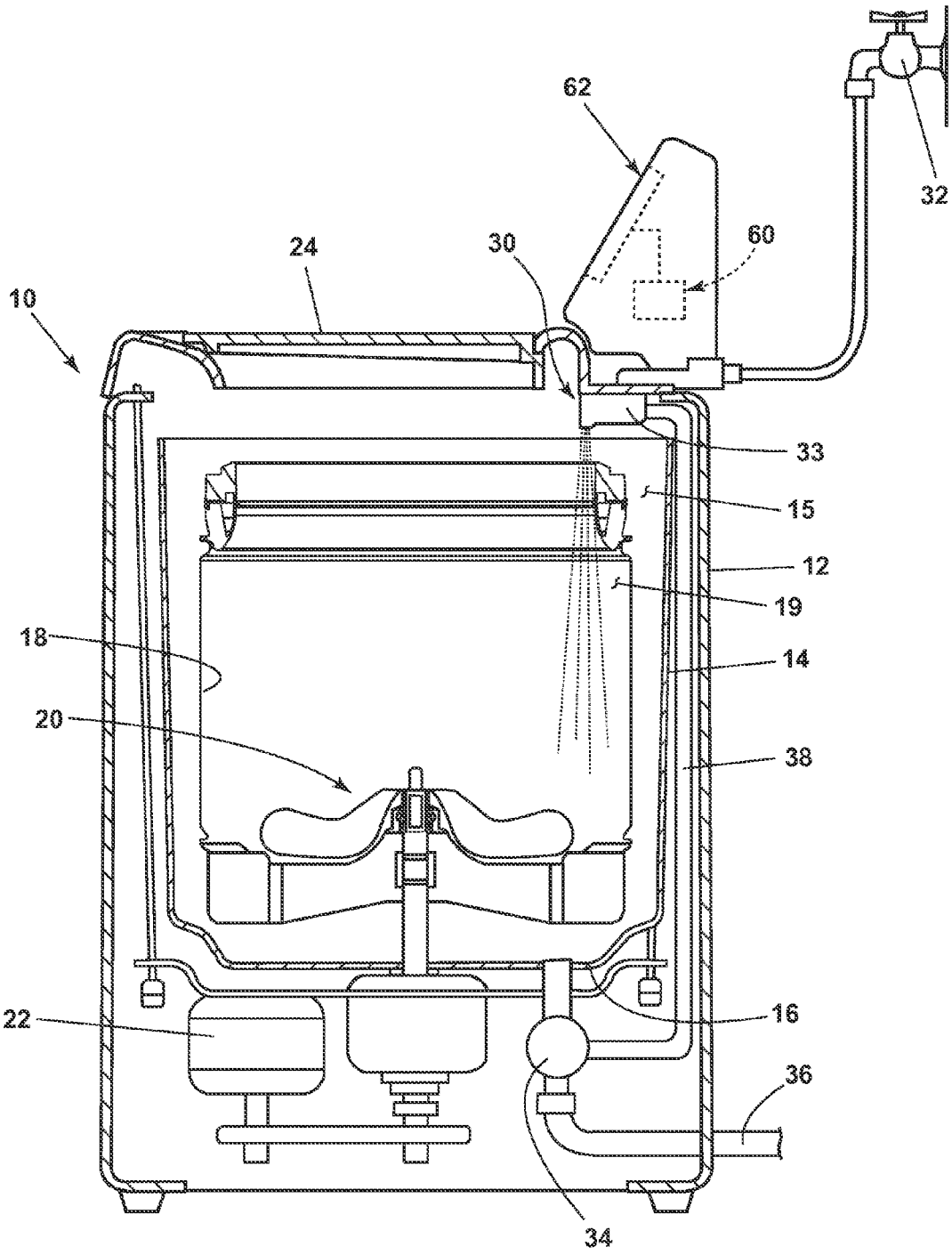
FIG. 1 is a schematic cross-sectional view of a laundry treating appliance according to one embodiment of the invention.

Referring now to the figures, FIG. 1 is a schematic view of an exemplary laundry treating appliance 10 in the form of a washing machine according to one embodiment of the invention. While the laundry treating appliance 10 is illustrated as a vertical axis, top-fill washing machine, the invention may have applicability in other laundry treating appliances, such as a horizontal washing machine, combination laundry treating appliance and dryer, an extractor, a non-aqueous laundry treating appliance, and a tumbling or stationary refreshing/revitalizing machine, for example.

The washing machine 10 may include a cabinet or housing 12 and an imperforate tub 14 that defines an interior 15 of the washing machine 10. A sump 16 may be in fluid communication with the interior 15 of the tub 14. A drum or perforated wash basket 18 may be located within and rotatable relative to the interior 15 of the tub 14 and may define a laundry treating chamber 19 for receiving a laundry load. The wash basket 18 may include a plurality of perforations or apertures (not shown) such that liquid supplied to the wash basket 18 may flow through the perforations to the tub 14. An agitator or clothes mover 20 may be located within the laundry treating chamber 19 and rotatable relative to and/or with the wash basket 18.

The wash basket 18 and/or the clothes mover 20 may be driven by an electrical motor 22, which may or may not include a gear case, operably connected to the wash basket 18 and/or the clothes mover 20. The clothes mover 20 may be commonly oscillated or rotated about its axis of rotation during a cycle of operation in order to provide movement to the fabric load contained within the laundry treating chamber 19. The wash basket 18 may be rotated at high speed to centrifugally extract liquid from the fabric load and to discharge it from the wash basket 18. The top of the housing 12 may include a selectively openable lid 24 to provide access into the laundry treating chamber 19 through the open top of the wash basket 18.

Still referring to FIG. 1, a spraying system 30 may be provided to spray liquid, such as water or a combination of water and one or more treating agents into the open top of the wash basket 18 and onto laundry placed within the laundry treating chamber 19. Non-limiting examples of treating chemistries that may be dispensed by the dispensing system during a cycle of operation include one or more of the following: water, surfactants, enzymes, fragrances, stiffness/sizing agents, wrinkle releasers/reducers, softeners, antistatic or electrostatic agents, stain repellants, water repellants, energy reduction/extraction aids, antibacterial agents, medicinal agents, vitamins, moisturizers, shrinkage inhibitors, and color fidelity agents, and combinations thereof.

The spraying system 30 may be configured to supply water directly from a household water supply 32 and/or from the tub 14 and spray it onto the laundry through a sprayer 33. The spraying system 30 may also be configured to recirculate wash water from the tub 14, including the sump 16, and spray it onto the laundry. The spraying system 30 can also include additional sprayers and other components to supply liquid to one or more additional locations, such as a portion of the interior 15 between the wash basket 18 and the tub 14, an exterior surface of the wash basket 18, an interior surface of the wash basket 18 and an internal surface of the tub 14. The nature of the spraying system is not germane to the invention, and thus any suitable spraying system may be used with the laundry treating appliance 10.

A pump 34 may be housed below the tub 14. The pump 34 may have an inlet fluidly coupled to the sump 16 and an outlet configured to fluidly couple to either or both a household drain 36 or a recirculation conduit 38. In this configuration, the pump 34 may be used to drain or recirculate liquid in the sump 16, which is initially sprayed into the wash basket 18, flows through the wash basket 18, and then into the sump 16. Alternatively, two separate pumps may be used instead of the single pump as previously described.

As used herein, the term wash liquid refers to a combination of water and one or more treating agents capable of generating suds. The terms rinse liquid and rinse water are interchangeable and refer to water supplied from the household water supply 32 that has not been mixed with a treating agent prior to being applied to the laundry. The terms recirculated liquid and recirculated water refer to water or a combination of water and one or more treating agents that is pumped from the sump 16 and re-applied to the laundry, with or without the addition of additional rinse liquid from the household water supply 32.

The washing machine 10 also includes a control system for controlling the operation of the washing machine 10 to implement one or more cycles of operation. The control system may include a controller 60 located within the cabinet 12 and a user interface 62 that is operably coupled with the controller 60. The user interface 62 may include one or more knobs, dials, switches, displays, touch screens and the like for communicating with the user, such as to receive input and provide output. The user may enter different types of information including, without limitation, cycle selection and cycle parameters, such as cycle options.

The controller 60 may include the machine controller and any additional controllers provided for controlling any of the components of the washing machine 10. For example, the controller 60 may include the machine controller and a motor controller. Many known types of controllers may be used for the controller 60. The specific type of controller is not germane to the invention. It is contemplated that the controller 60 is a microprocessor-based controller that implements control software and sends/receives one or more electrical signals to/from each of the various working components to effect the control software. As an example, proportional control (P), proportional integral control (PI), and proportional derivative control (PD), or a combination thereof, a proportional integral derivative control (PID control), may be used to control the various components.

Figure 2:
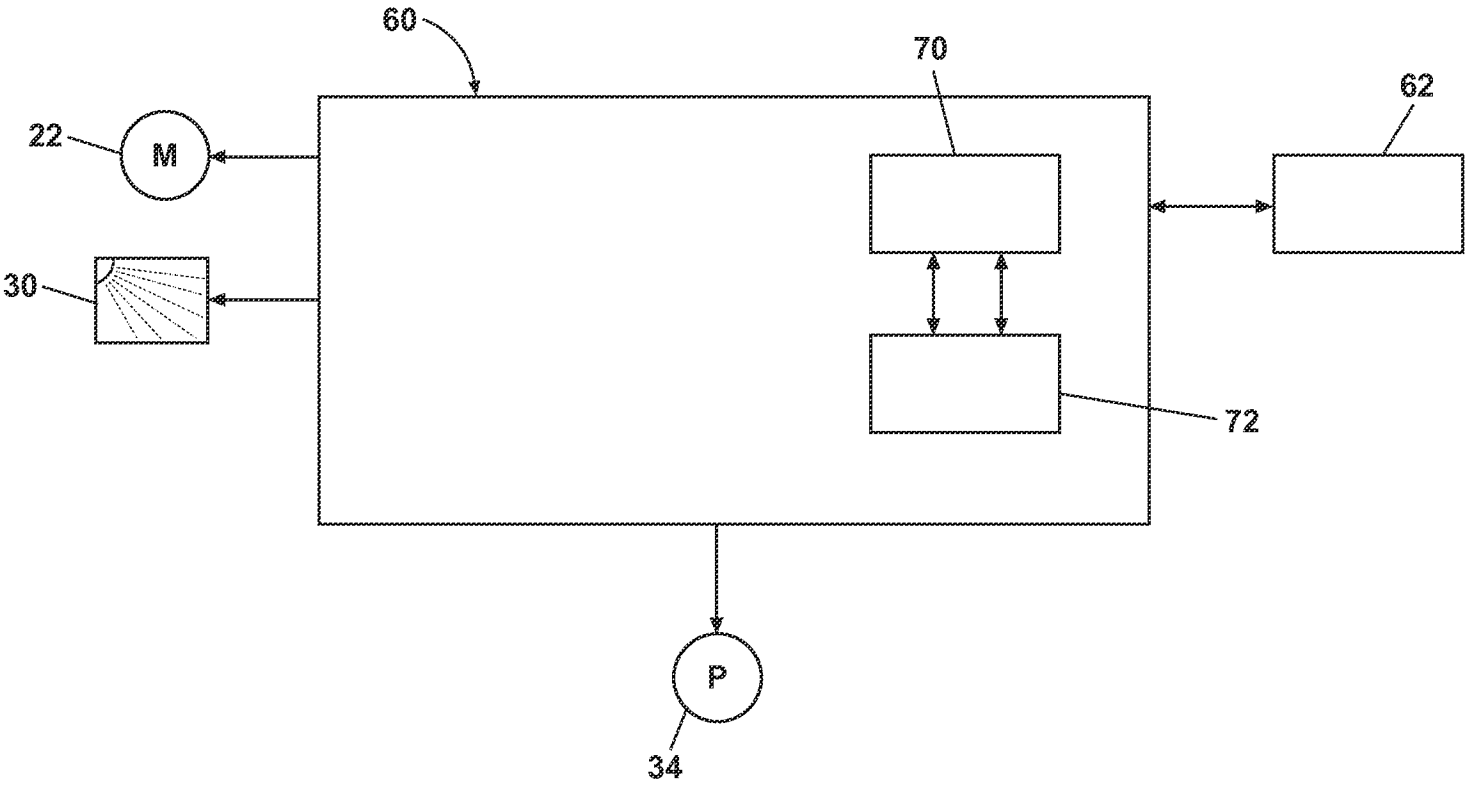
FIG. 2 is a schematic view of a controller of the laundry treating appliance of FIG. 1.

As illustrated in FIG. 2, the controller 60 may be provided with a memory 70 and a central processing unit (CPU) 72. The memory 70 may be used for storing the control software that is executed by the CPU 72 in implementing a cycle of operation using the washing machine 10 and any additional software. Examples, without limitation, of cycles of operation include: wash, heavy duty wash, delicate wash, quick wash, pre-wash, refresh, rinse only, and timed wash. A common wash cycle includes a wash phase, a rinse phase, and a spin extraction phase. Other phases for cycles of operation include, but are not limited to, intermediate extraction phases, such as between the wash and rinse phases, and a pre-wash phase preceding the wash phase, and some cycles of operation include only a select one or more of these exemplary phases.

The memory 70 may also be used to store information, such as a database or table, and to store data received from one or more components of the washing machine 10 that may be communicably coupled with the controller 60. The database or table may be used to store the various operating parameters for the one or more cycles of operation, including factory default values for the operating parameters and any adjustments to them by the control system or by user input.

The controller 60 may be operably coupled with one or more components of the washing machine 10 for communicating with and controlling the operation of the component to complete a cycle of operation. For example, the controller 60 may be operably coupled with the motor 22, the pump 34, and the spraying system 30 to control the operation of these and other components to implement one or more of the cycles of operation.

The previously described washing machine 10 may be used to implement one or more embodiments of the invention. The embodiments of the method of the invention may be used to control the operation of the washing machine 10 to minimize the formation of a surfactant foam or suds in the tub 14 to mitigate a suds lock condition. As used herein, mitigating a suds lock condition may include decreasing the formation of suds and/or removing suds from the tub 14 such that a suds lock condition is avoided or the effect of the suds on the tub 14 and wash basket 18 is decreased.

A typical wash cycle includes a wash phase in which a wash liquid, e.g., a mixture of water and surfactants (and optionally other treating agents), is applied to the laundry, a rinse phase in which the wash liquid is removed from the laundry by rinsing the laundry with rinse liquid, and a spin extraction phase in which at least a portion of the rinse liquid is extracted from the laundry by spinning the laundry at high speeds. A suds lock condition occurs when the wash liquid forms suds and the suds interact with the wash basket 18 and tub 14, causing excess frictional drag between the wash basket 18 and the tub 14. The excess frictional drag may inhibit the wash basket 18 from accelerating to a desired wash basket rotation speed, such as a final or spin extraction rotation speed in which the laundry is rotated at high speeds to extract liquid from the laundry. The methods described herein may be used to mitigate a suds lock condition such that the wash basket 18 may be rotated at a desired rotation speed while decreasing or minimizing the frictional drag between the wash basket 18 and the tub 14 effected by the presence of suds in the tub 14.

Figure 3:
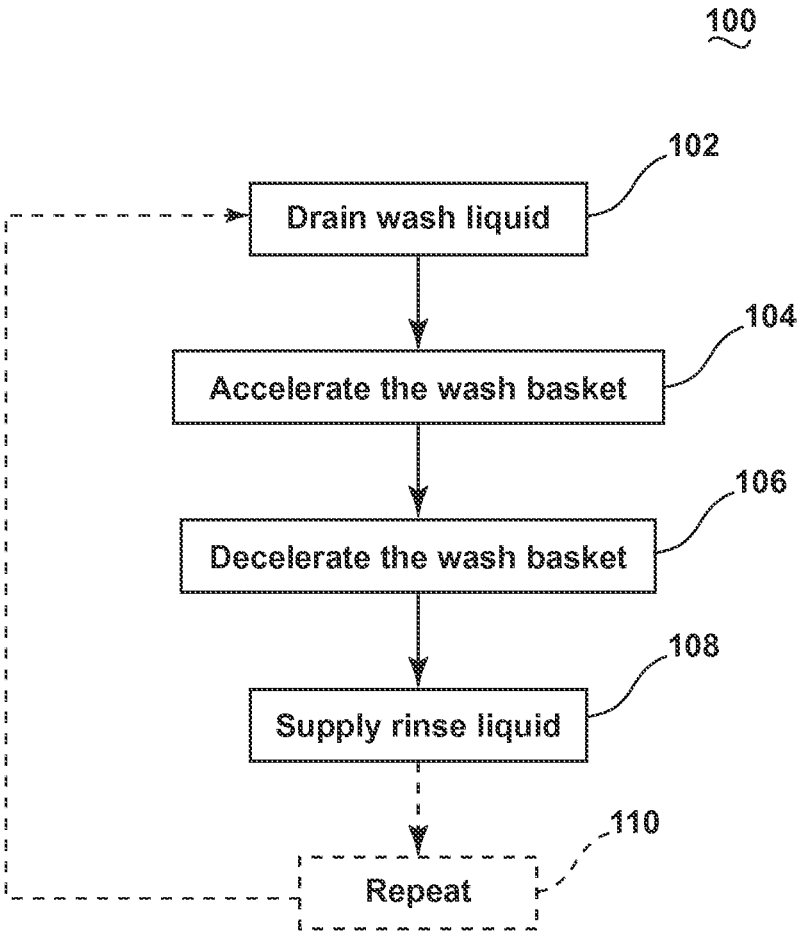
FIG. 3 is a flow chart illustrating a method for mitigating a suds lock condition according to an embodiment of the invention.

Referring now to FIG. 3, a flow chart of a method 100 for mitigating a suds lock condition during a cycle of operation is illustrated. The method 100 may be used during a wash cycle or any other cycle of operation in which wash liquid is or has been applied to the laundry. The method 100 may be implemented as part of a wash or rinse phase of a wash cycle or may be implemented as a separate phase. The sequence of steps depicted for this method is for illustrative purposes only, and is not meant to limit the method in any way as it is understood that the steps may proceed in a different logical order or additional or intervening steps may be included without detracting from the invention.

The method 100 starts with assuming that a cycle of operation in which a wash liquid is applied to the laundry in the treating chamber 19, such as a wash cycle, has been implemented. At 102, the drain pump 34 may be activated to drain at least a portion of any wash liquid that has collected in the sump 16. The drain pump 34 may be activated at 102 when the wash basket 18 is at or near 0 rpm and may be activated for a predetermined period of time or until a predetermined amount of wash liquid has been drained from the sump 16. At 104, the motor 22 can be activated to accelerate the wash basket 18 to rotate at a first predetermined rotation speed.

At 106, the wash basket 18 may be decelerated from the first predetermined rotation speed reached at 102. The wash basket 18 may be passively decelerated by deactivating the motor 22 and allowing the wash basket 18 to simply coast and decelerate. Alternatively, the wash basket 18 may be actively decelerated by activating the motor 22 to brake the wash basket 18 or apply another braking mechanism, and increase the rate of deceleration. The wash basket 18 may be decelerated from the first predetermined rotation speed reached at 102 to a predetermined rotation speed, less than the first, such as 0 rpm, for example. The wash basket 18 may be decelerated from the first predetermined rotation speed after a predetermined amount of time or immediately upon reaching the first predetermined rotation speed.

At 108, rinse liquid may be supplied to the tub 14, such as through the sprayer 33, for example, during the deceleration of the wash basket 18 at 106. The rinse liquid may be supplied during the entire deceleration phase from the first predetermined rotation speed or only during a portion of the deceleration phase. For example, rinse liquid may be supplied to the tub 14 when the rotation speed of the wash basket 18 reaches or decreases below a predetermined threshold. In another example, the rinse liquid may be supplied after a predetermined amount of time following the start of the deceleration phase at 106.

The rinse liquid may be supplied at 108 either continuously or intermittently. The supplying of the rinse liquid at 108 may end after a predetermined period of time or when the rotation speed of the wash basket 18 reaches or decreases below a predetermined threshold. In one example, the supplying of the rinse liquid at 108 may continue until the wash basket rotation speed reaches 0 rpm. The deceleration phase 106 and rinse liquid supply phase 108 may end concurrently or non-concurrently.

As used herein, supplying rinse liquid to the tub 14 includes supplying rinse liquid to one or more locations within the area defined by the tub 14. Supplying rinse liquid to the tub 14 may include supplying rinse liquid to the interior 15 at a space between the tub 14 and the wash basket 18, an exterior surface of the wash basket 18, an interior surface of the wash basket 18, the treating chamber 19, an internal surface of the tub 14, and combinations thereof and may include supplying rinse liquid from one or more sprayers, such as the sprayer 33, for example, or other liquid supply devices provided in the washing machine 10.

At 110, the draining phase 102, acceleration phase 104, deceleration phase 106 and rinse liquid supply phase 108 may be repeated one or more times. Each time the acceleration phase 104 is repeated, the wash basket 18 may be accelerated to the same predetermined wash basket rotation speed or a different wash basket rotation speed. In one example, the wash basket 18 may be accelerated to successively higher wash basket rotation speeds each time the acceleration phase 104 is repeated.

It will be understood that at least some of the rinse liquid supplied to the tub 14 during the rinse liquid supply phase at 108 may collect in the sump 16 and mix with the wash liquid that has also collected in the sump 16. Thus, when the method 100 is repeated, during the draining phase 102, it will be understood that draining the wash liquid may also include draining rinse liquid that has mixed with the wash liquid and collected in the sump 16.

Draining the wash liquid at 102 and subsequently supplying rinse liquid at 108 dilutes the wash liquid present in the tub 14 and thus reduces the amount of suds that may form and/or disrupt suds that have already formed. If the wash liquid is drained too quickly or too much wash liquid is drained at 102, suds may form from the agitation of the mixture of water and surfactants in the wash liquid, and a suds lock condition may occur. The rinse liquid may be supplied at 108 while the wash basket 18 is decelerating to gradually dilute the wash liquid and any suds that may have formed while minimizing the formation of additional suds. In this manner, the method 100 may be used to rinse away enough wash liquid, while mitigating a suds lock condition, such that the wash basket 18 may be rotated up to an extraction spin speed in an extraction phase of the wash cycle without generating excessive suds that could lead to a suds lock condition.

Figure 4:
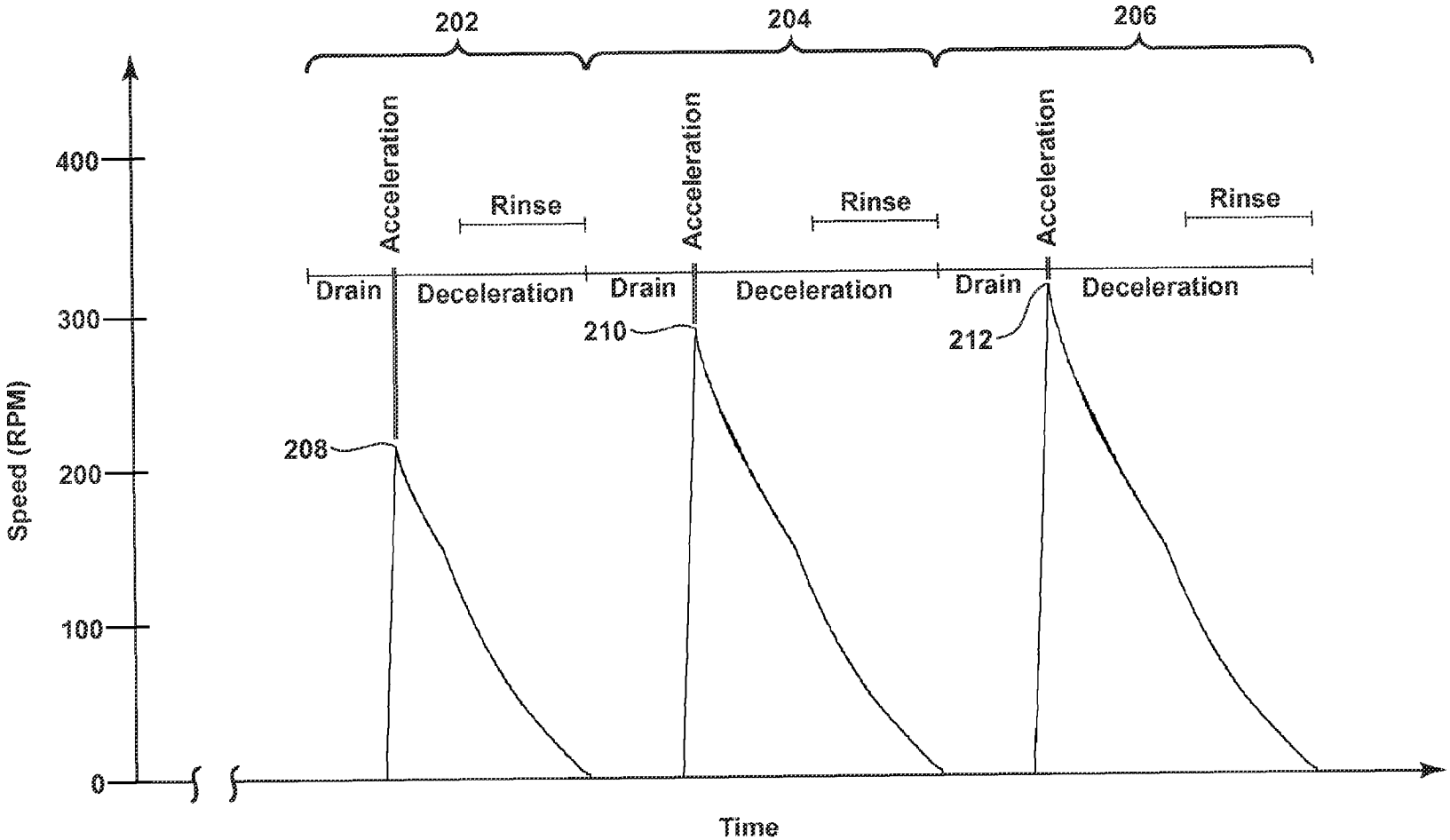
FIG. 4 is a graphical representation of a wash basket speed profile according to an embodiment of the invention.

Referring now to FIG. 4, an exemplary wash basket speed profile 200 is illustrated. The wash basket speed profile 200 illustrates the speed of the wash basket 18 during implementation of the method 100 of FIG. 3 in the course of a cycle of operation. The wash basket speed profile 200 may not be indicative of actual data, but is included for the purposes of illustration.

FIG. 4 illustrates three successive suds-mitigating stages 202, 204 and 206, which may be implemented at a predetermined time period subsequent to a wash cycle in which the laundry is treated with a wash liquid including surfactants. Each of the suds-mitigating stages 202, 204 and 206 include a drain phase, an acceleration phase, a deceleration phase, and a rinse liquid supply phase. During the first stage 202, the drain pump 34 may be activated to drain at least a portion of the wash liquid collected in the sump 16. Near or at the end of the drain phase, the wash basket 18 may be accelerated to a first predetermined rotation speed 208, such as 200 rpm, for example, during the acceleration phase. Upon reaching the first predetermined rotation speed 208, the motor 22 may be turned off and the wash basket 18 may be allowed to coast down to 0 rpm during the deceleration phase. During the deceleration phase, when the wash basket rotation speed decreases to 150 rpm, the spraying system 30 may be activated to supply rinse liquid to the tub 14. The rinse liquid supply phase may continue during the deceleration phase until the wash basket rotation speed decreases to at or near 0 rpm.

Following the first stage 202, the second stage 204 begins with a drain phase and acceleration phase similar to the first stage 202 except that during the acceleration phase, the wash basket 18 is accelerated to a second predetermined rotation speed 210, which is higher than the first predetermined rotation speed 208, such as 290 rpm, for example. The wash basket 18 may then be allowed to decelerate and rinse liquid supplied when the wash basket rotation speed decreases to 150 rpm in a manner similar to that described above for the first stage 202. The third stage 206 is similar to the first and second stages 202 and 204 except that during the acceleration phase, the wash basket 18 is accelerated to a third predetermined rotation speed 212, higher than the second predetermined rotation speed 210. Each time the wash liquid is drained from the tub 14 and rinse liquid is supplied, the wash liquid is diluted. Diluting the wash liquid dilutes the amount of surfactant present in the tub 14, decreasing the amount of suds that may be generated and/or diminishing suds that have already formed.

The methods described herein may be used to mitigate the formation of a suds lock condition in a washing machine. Excess suds in a washing machine may increase the frictional drag between the wash basket and the tub, which may result in the wash basket not reaching a desired rotational speed or may require additional energy to reach the desired rotation speed, which may increase energy costs during the cycle. During a spin extraction phase, the wash basket is rotated at high speeds to remove liquid from the laundry for subsequent treatment or drying. If the wash basket cannot be rotated at the desired spin extraction speed due to a suds lock condition, it may take longer to extract liquid from the laundry, which may provide an undesirable lengthening of the cycle, or the laundry may maintain more liquid at the end of the cycle, which may be undesirable to the user. The methods described herein may be used to rinse the laundry in such a manner as to mitigate a suds lock condition and decrease the interaction between the tub and the wash basket during rotation of the wash basket.

To the extent not already described, the different features and structures of the various embodiments may be used in combination with each other as desired. That one feature may not be illustrated in all of the embodiments is not meant to be construed that it cannot be, but is done for brevity of description. Thus, the various features of the different embodiments may be mixed and matched as desired to form new embodiments, whether or not the new embodiments are expressly described.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A method of operating a laundry treating appliance having a tub defining an interior, with a wash basket rotatably mounted within the interior and at least partially defining a treating chamber for receiving laundry for treatment in accordance with a cycle of operation, the tub having a wash liquid, the method comprising:

a) draining at least a portion of the wash liquid from the tub;

b) accelerating the wash basket to a first wash basket rotation speed;

c) enabling the wash basket to decelerate from the first wash basket rotation speed to a wash basket rotation speed less than the first wash basket rotation speed;

d) supplying a rinse liquid to the tub during at least a portion of the deceleration of the wash basket from the first wash basket rotation speed; and e) repeating steps a) through d), wherein the repeated b) accelerating the wash basket includes accelerating the wash basket to successively higher wash basket rotation speeds.

2. The method of claim 1 wherein the wash liquid comprises at least one surfactant.

3. The method of claim 1, further comprising accelerating the wash basket to a second wash basket rotation speed, higher than the first wash basket rotation speed, subsequent to the accelerating of the wash basket to the first wash basket rotation speed, and supplying a rinse liquid to the tub during at least a portion of a deceleration of the wash basket from the second wash basket rotation speed.

4. The method of claim 3, further comprising accelerating the wash basket to a third wash basket rotation speed, higher than the second wash basket rotation speed, subsequent to the accelerating of the wash basket to the second wash basket rotation speed, and supplying a rinse liquid to the tub during at least a portion of a deceleration of the wash basket from the third wash basket rotation speed.

5. The method of claim 1 wherein supplying a rinse liquid to the tub comprises at least one of supplying rinse liquid to a space between the tub and the wash basket, an exterior surface of the wash basket, an interior surface of the wash basket, the treating chamber, an internal surface of the tub, and combinations thereof.

6. The method of claim 1, further comprising accelerating the wash basket to an extraction speed to extract liquid from the laundry.

7. The method of claim 1 wherein enabling the wash basket to decelerate comprises at least one of passive deceleration during coasting and active deceleration during braking.

8. A laundry treating appliance comprising:

a tub defining an interior with a wash basket rotatably mounted within the interior and at least partially defining a treating chamber for receiving laundry for treatment with a wash liquid in accordance with a cycle of operation;

a motor operably coupled with the wash basket to rotate the wash basket within the tub;

a liquid supply system configured to supply rinse liquid to the tub;

a drain pump configured to drain wash liquid from the tub; and a controller configured to:

a) drain at least a portion of the wash liquid from the tub;

b) accelerate the wash basket to a first wash basket rotation speed;

c) enable the wash basket to decelerate from the first wash basket rotation speed to a wash basket rotation speed less than the first wash basket rotation speed; and d) supply a rinse liquid to the tub during at least a portion of the deceleration of the wash basket from the first wash basket rotation speed; and e) repeating steps a) through d), wherein the repeated b) accelerating the wash basket includes accelerating the wash basket to successively higher wash basket rotation speeds.

9. The laundry treating appliance of claim 8 wherein the wash liquid comprises at least one surfactant.

10. The laundry treating appliance of claim 8 wherein the controller is further configured to accelerate the wash basket to a second wash basket rotation speed, higher than the first wash basket rotation speed, subsequent to the accelerating of the wash basket to the first wash basket rotation speed, and supply a rinse liquid to the tub during at least a portion of a deceleration of the wash basket from the second wash basket rotation speed.

11. The laundry treating appliance of claim 10 wherein the controller is further configured to accelerate the wash basket to a third wash basket rotation speed, higher than the second wash basket rotation speed, subsequent to the accelerating of the wash basket to the second wash basket rotation speed, and supply a rinse liquid to the tub during at least a portion of a deceleration of the wash basket from the third wash basket rotation speed.

12. The laundry treating appliance of claim 8 wherein the controller is further configured to at least one of deactivate the motor to passively decelerate the wash basket and actively decelerate the wash basket by braking.

13. The laundry treating appliance of claim 8 wherein the liquid supply system is configured to supply rinse liquid to at least one of a space between the tub and the wash basket, an exterior surface of the wash basket, an interior surface of the wash basket, the treating chamber, an internal surface of the tub, and combinations thereof during the supplying of a rinse liquid to the tub.

* * * * *